US005348092A

United States Patent [19]

Cornette et al.

[11] Patent Number: 5,348,092

[45] Date of Patent: Sep. 20, 1994

[54] GRAVEL PACK ASSEMBLY WITH TUBING SEAL

[75] Inventors: H. Mitchell Cornette; Stephen E. Morrison, both of Houston; Michael J. Barton, Angleton, all of Tex.

[73] Assignee: Atlantic Richfield Company, Los Angeles, Calif.

[21] Appl. No.: 38,436

[22] Filed: Mar. 26, 1993

[51] Int. Cl.[5] ..... E21B 43/08

[52] U.S. Cl. ..... 166/227; 166/114; 166/116; 166/157; 166/242

[58] Field of Search ..... 166/242, 74, 116, 115, 166/114, 157, 158, 205, 51, 278, 227

[56] References Cited

U.S. PATENT DOCUMENTS

| | | | |
|---|---|---|---|
| 2,138,057 | 11/1938 | Armentrout et al. | 166/205 X |
| 2,368,428 | 1/1945 | Saurenman | 166/114 |
| 2,905,248 | 9/1959 | Todt | 166/114 X |
| 2,905,249 | 9/1959 | Ownbey | 166/157 X |
| 3,252,515 | 5/1966 | Donaldson et al. | 166/114 |
| 3,710,864 | 1/1973 | Mitchell | 166/242 X |
| 5,036,920 | 8/1991 | Cornette et al. | 166/278 |
| 5,145,004 | 9/1992 | Cornette | 166/278 |

*Primary Examiner*—Hoang C. Dang
*Attorney, Agent, or Firm*—Michael E. Martin

[57] ABSTRACT

A sand control screen installation for a well includes an auger type sand control screen connected to a length of smooth-walled tubing which is disposed in a tubing seal support sub connected to a packer and having a frangible coupling interconnecting the tubing with the sub whereby the assembly may be pre-installed in a wellbore, the packer set and the tubing decoupled from the sub for reciprocation relative thereto while a fluid tight seal is maintained between portions of the wellbore to prevent underbalanced or overbalanced fluid flow during installation of the sand control screen. In an alternate embodiment, the tubing seal support sub has suitable lock mechanism for installation in a landing nipple in wells with pre-installed tubing strings and packers.

10 Claims, 2 Drawing Sheets

GRAVEL PACK ASSEMBLY WITH TUBING SEAL

BACKGROUND OF THE INVENTION

1. Field of the Invention

The present invention pertains to a gravel pack assembly for installation in a well having a tubing seal connected below the packer to permit rotary and reciprocal movement of an auger gravel pack screen during installation without permitting fluid flow through the packer bore in the event of an underbalanced or overbalanced condition in the well.

2. Background

Auger type gravel pack screen assemblies have become increasingly popular for installations where a gravel packing around a sand control screen is required to control the flow of sand and other solids particulates in fluid production wells. U.S. Pat. No. 5,036,920, issued Aug. 6, 1991 to Cornette, et al and assigned to the assignee of the present invention describes one embodiment of an auger type gravel pack screen and a method of installation. Although the auger type gravel pack screen is particularly advantageous for many sand control screen installations in wells, one problem which must be overcome during installation of an auger type gravel pack screen is the prevention of fluid flow both out of and into the gravel packing, that is, when the well is in an underbalanced or overbalanced fluid flow condition. It is difficult to provide a suitable fluid tight seal between spaced apart zones in the wellbore during the installation of an auger type gravel pack sand control screen due to the fact that the screen is preferably reciprocated in the well during the augering process. Although seal bore type packers may be installed in the well to control fluid flow between different zones, as the tubing string to which the gravel pack screen is connected is reciprocated through the packer, the packing or seal rings on the tubing string sub which engages the packer seal bore invariably moves into and out of the bore. This action often results in high velocity fluid flow in one or the other direction through the bore of the packer or other seal member. This fluid flow and the resultant pressure drop across the packing on the tubing sub can severely damage the packing and there is also the inevitable movement of fluid into an unwanted area of the wellbore. Accordingly, there has been a need to overcome the aforementioned problem associated with installing gravel pack screens and particularly auger type gravel pack screens. This problem is solved by the gravel pack screen assembly of the present invention.

SUMMARY OF THE INVENTION

The present invention provides an improved gravel pack screen assembly for installation in a well wherein a tubing seal member is provided which substantially prevents unwanted flow of fluid through the well during installation of the gravel pack screen. The improved assembly includes a sub member having one or more elastomeric seal rings supported thereon for engaging a portion of a tubing string to which a gravel pack screen is connected and which tubing string may extend through a wellbore seal member such as a wellbore packer or the like.

In accordance with an important aspect of the present invention, an auger type sand control screen assembly is provided having an auger sand control screen connected to a section of tubing string which is extensible through a tubing seal support sub which may be connected to a wellbore packer or which may be installed in a tubing string already in place in a well. The sand control screen and tubing assembly is temporarily secured to the seal support sub so that the sub may be conveyed into a well and then secured in the well whereupon the sand control screen and the tubing string connected thereto may be released from the sub for reciprocal movement in the wellbore to facilitate installation of the sand control screen while preventing unwanted flow of fluid through the well.

The present invention is characterized in one embodiment by a sand control screen connected to a section of tubing of substantially constant diameter by way of a so-called running tool and wherein the tubing extends through a seal support sub which forms a substantially fluid tight seal with the tubing. The sub may be connected to a packer which is run into the well with the auger sand control screen and tubing assembly to permit reciprocation of the auger sand control screen during installation into a gravel packing and to also permit withdrawal of the tubing and a running tool after completion of the screen installation. Another embodiment of the sand control screen assembly is characterized by a seal support sub which has suitable locking mechanism for locking the sub into the distal end of a tubing string already installed in the well whereby the tubing to which the sand control screen is connected may be reciprocated with the sand control screen and then eventually disconnected from the sand control screen while preventing unwanted flow of fluid in the well.

Those skilled in the art will recognize the above-described features and advantages of the invention as well as other superior aspects thereof upon reading the detailed description which follows in conjunction with the drawing.

DESCRIPTION OF PREFERRED EMBODIMENTS

Figure 1:
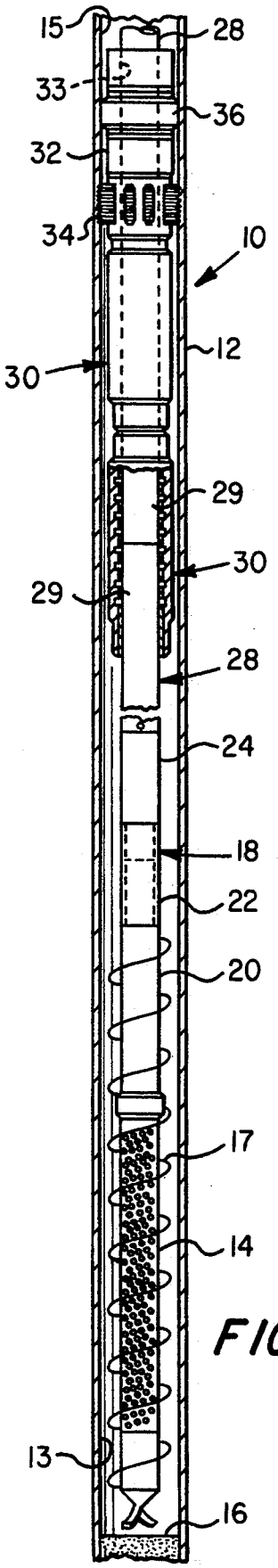
FIG. 1 is an elevation of a gravel pack sand control screen assembly of the present invention being installed in a wellbore.

In the description which follows, like parts are marked throughout the specification and drawing with the same reference numerals, respectively. Certain conventional and commercially available elements are shown in schematic form in the interest of clarity and conciseness.

Referring to FIG. 1, there is illustrated a portion of a well 10 including an elongated, generally cylindrical metal casing 12 defining a wellbore 13. The well 10 is shown in preparation for the installation of an auger type sand control screen, generally designated by the numeral 14, having at least one helical auger flite 17 disposed thereon. The sand control screen 14 is preferably of the type described in U.S. Pat. No. 5,036,920. The sand control screen 14 is shown disposed just above a column of gravel packing 16 in the casing 12. The packing 16 has been installed in accordance with known techniques for the purpose of controlling the production of sand which is carried into the wellbore 13 by produced fluids from a formation, not shown, into which the well 10 has been drilled. A preferred method of installing the auger type sand control screen 14 requires that the screen be reciprocated in the casing 12 while being rotated to loosen the gravel packing 16 and to facilitate augering the screen into the packing.

Moreover, it is not unusual for the well 10 to be in a so-called underbalanced or overbalanced condition, that is, where there is a tendency for fluid to flow downward through the wellbore 13 into the gravel packing 16 or in the opposite direction, that is, from the formation zone communication with the gravel packing into the wellbore 13 and upwardly through the casing 12. This flow of fluid is generally unwanted, particularly during installation of the sand control screen 14 as is known to those skilled in the art of sand control screens and their installation methods. With the improved and unique sand control screen assembly of the present invention, the flow of fluid within the wellbore 13 either upwardly from the gravel packing 16 or downwardly into the gravel packing is substantially prevented during installation of the screen 14.

The sand control screen 14 is part of a unique assembly, generally designated by the numeral 18, which includes a conventional so-called blank pipe section 20 of the screen 14 which is suitably connected to a commercially available tubing section 22 known as a hook-up nipple. One example of a commercially available hook-up nipple is available from Baker Sand Control division of Baker Hughes Incorporated, Houston, Tex. The hook-up nipple 22 is releasably connected to a hydraulic nipple running tool 24, also commercially available from Baker Sand Control. Suffice it to say that, after suitably augering the sand control screen 14 and its blank pipe section 20 into the gravel packing 16, the running tool 24 may be disconnected from the hook-up nipple 22 so that the assembly of the screen 14, blank pipe section 20 and hook-up nipple 22 remain in the well 10 while the running tool 24 and certain other elements to be described are withdrawn from the wellbore, if desired.

Referring further to FIG. 1, the running tool 24 is connected to a substantially constant diameter smooth-walled tubing section, generally designated by the numeral 28, which extends through one or more unique tubing seal support subs 30, two shown, connected end to end and to a conventional wellbore packer 32. The tubing 28 extends through the packer 32 as indicated, and may be connected to a conventional oil or gas well workstring, not shown, for use in installing the sand control screen 14 and the screen assembly 18. The packer 32 includes a conventional central bore 33, casing gripping elements or slips 34 and an actuatable resilient annular seal 36 which, upon positioning of the packer 32 in a desired position in the casing 12, is radially extended into fluid tight sealing engagement with the inside wall of the casing. The packer 32 may be one of several types which are capable of being conveyed into a well casing or into an open hole wellbore and then set to prevent fluid flow from above as well as below the packer through the wellbore. One type of packer which is suitable for use in the assembly 18 is a Model A3 "Lok-Set" Retrievable Casing Packer manufactured by Baker Oil Tools, division of Baker Hughes Company, Houston, Tex.

The sand control screen assembly including the screen 14, blank pipe section 20, nipple 22, running tool 24, tubing 28, together with the subs 30 and the packer 32, may be run into the casing 12 connected to the aforementioned conventional workstring. Once the screen 14 is in a predetermined position above the gravel packing 16, the workstring is suitably rotated to set the packer 32 to engage the slips 34 and the seal element 36 with the casing 12 in accordance with setting mechanism, not shown, provided for the above-mentioned type of packer, for example. Once the packer 32 is set, the tubing 28 and the members connected thereto may be moved downwardly under a suitable force to separate a frangible coupling, to be described in further detail herein, between the tubing 28 and the packer 32 or, preferably, between the tubing and one of the subs 30. Once this separation or decoupling has occurred, the tubing 28, together with the screen 14 and the intervening elements, may be reciprocated and rotated relative to the packer 32 and the subs 30.

Although the packer 32 forms a seal between its outer surface and the casing 12 to prevent flow of fluid thereacross through the casing, there should also be a seal between the tubing 28 and the packer or the subs 30. The subs 30 are particularly adapted to form such an improved seal to permit rotation and reciprocation of the tubing 28 as well as the sand control screen 14 during its installation procedure. The illustration of FIG. 1, in fact, shows the assembly 18 with the packer 32 in its set and locked position and the tubing 28, together with the screen 14 and the intervening elements decoupled from the lower sub 30 for reciprocation and rotary movement relative to the subs 30 and the packer.

Figure 2:
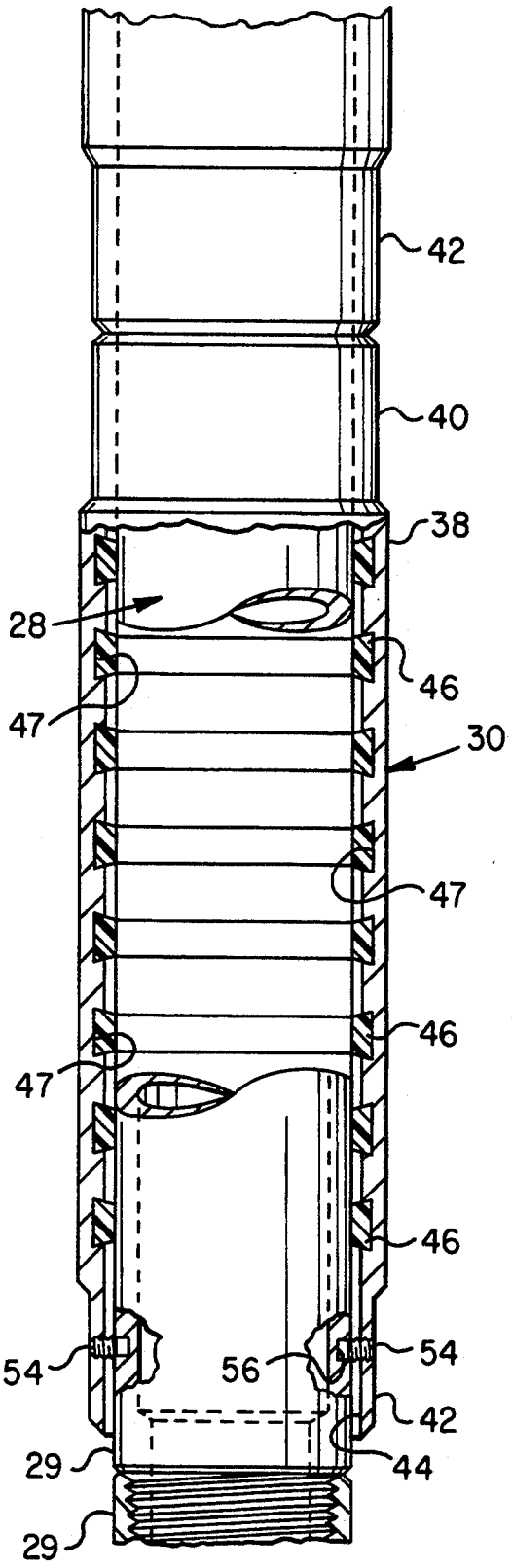
FIG. 2 is a detail view, partially sectioned, of the tubing seal support sub for the sand control screen assembly.
Figure 4:
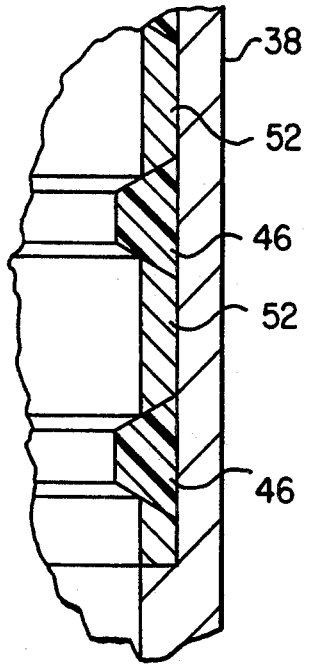
FIG. 4 is a detail view of one of the annular elastomeric seals and a modified form of its support structure.
Figure 3:
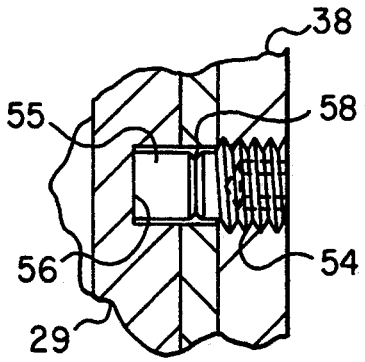
FIG. 3 is a detail section view of the temporary connection between the tubing of the sand control screen assembly and the seal support sub.

Referring now to FIGS. 2, 3 and 4, one of the subs 30 is shown in further detail as being characterized by a generally elongated cylindrical body 38 having slightly reduced diameter opposed end portions 40 and 42 which may be provided with suitable threads, not shown, for coupling the subs to each other and to the packer 32, for example. The subs 30 are each provided with a cylindrical bore 44 in which are disposed a plurality of spaced-apart annular resilient seal elements 46 which are dimensioned to sealingly engage the outer wall surface of the tubing 28, the seal elements 46 may be suitably disposed in dovetail circumferential grooves 47 formed in the body 38 and be of a suitable elastomer seal element material compatible with the conditions expected in the well 10. The seal elements 46 may be elastically deformed to fit into the dovetail grooves 47, molded in place in the grooves, or the body 38 may be modified as shown in FIG. 4 to provide for alternate spaced-apart seal elements 46 and suitable retaining spacers 52 formed of a hard material such as metal. Other suitable seal elements may be used such as so-called Chevron type packing which may be retained in the bore 44 of the sub 30 in a manner similar to that illustrated in FIG. 4. The seal elements 46 may also, but less preferably, be formed as O-rings or quad-rings, for example. The smooth-walled tubing 28 may be made up of several joints or sections 29 of tubing which are connected with a so-called flush joint type connection as illustrated in FIG. 2. The tubing 28 may be made up of tubing sections 29, for example, having opposed ends which are formed to have pin and box threads, respectively, all in a conventional manner.

Referring further to FIGS. 2 and 3, at least one of the subs 30 is adapted to be temporarily coupled to the tubing 28 by opposed shear pins 54 which are suitably threadedly engaged with the end portion 42 of the sub 30 and extend radially inwardly into the bore 44 and into cooperating pin receiving bores 56 formed in the sidewall of one of the tubing sections 29. The pin receiving bores 56 may be frustoconical shaped and of slightly larger diameter than the shear pins 56. The shear pins 56 may be suitably circumferentially notched at 58, FIG. 3, to form a preferential shear point when an axial force exerted on the tubing 28 tends to move the tubing axially through the sub 30. A preferred method of decoupling the tubing 28 from the sub 30 would be to push downwardly on the tubing 28 until the pins 56 shear whereupon the tubing section 29, having the pin bores 56 therein, would move out of the bore 44 and the stub ends 55 of the pins 54 will then fall harmlessly out of the bores 56 and into the wellbore 13. In this way, as the tubing 28 is reciprocated within the sub 30 and past each of the seal elements 46, there is little likelihood of damage to the seals from the sharp sheared ends of the pins. By providing the tubing seal subs 30 with the stationary seal elements 46 disposed therein, the tubing 28 may be reciprocated with respect to the packer 32 and the subs 30 without losing fluid tight sealing engagement therewith. In conventional seal bore packer arrangements, seal elements are placed on the tubing or mandrel section which reciprocates within the bore and if the seal elements move out of the bore, a substantial pressure drop occurs across the seals which may damage them, and, of course, fluid tight engagement between the seal carrying member and the seal bore member is lost.

Accordingly, the sand control screen assembly 18 is lowered into the casing 12 with one or more of the subs 30 connected to the packer 32 and coupled to the tubing 28 by the shear pins 54 in the manner described above and shown in FIGS. 2 and 3. Once the packer 32 has been set by the rotational and axial movement of the assembly 18 required for such action, sufficient force is exerted on the tubing 28 to shear the pins 54 and allow the tubing 28 to move downwardly until the stub ends of the pins are clear of the bore 44 and fall out of the bores 56. The screen 14 may then be reciprocated and rotated to effectively install it in the gravel packing 16 in accordance with preferred methods for installing this type of screen. Other types of sand control screens may, however, also be installed using the novel features of the present invention including the arrangement of the subs 30, the packer 32 and the frangible coupling between the tubing 28 and the subs. Once the screen 14 has been properly set in the gravel packing 16, the running tool 24 may be decoupled from the nipple 22 and the running tool together with the tubing 28 withdrawn from the well. Under these conditions, fluid flow may occur through the subs 30 and the bore 33 of the packer 32 in either direction. Alternatively, the tubing 28 may be connected directly to the blank pipe section 20 at its lower end and the hydraulic running tool 24 and the hook-up nipple 22 installed at the upper end of the tubing 28 and above the packer 32 so that a sufficient elongated section of tubing 28 remains sealingly disposed in the sub 30 once the screen 14 has been installed in the gravel packing.

Figure 5:
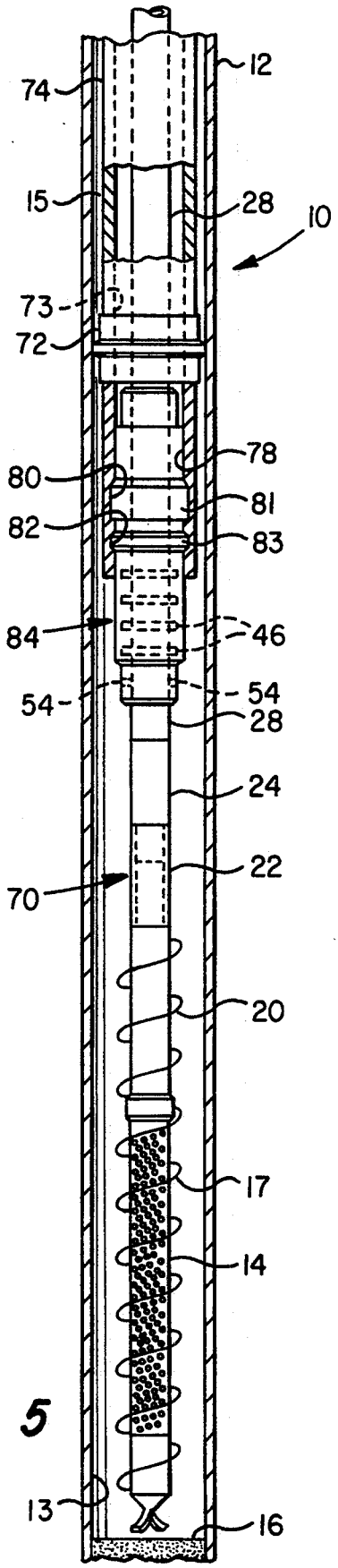
FIG. 5 is an elevation of an alternate embodiment of a sand control screen assembly in accordance with the present invention.

Referring now to FIG. 5, an alternate embodiment of a sand control screen assembly is illustrated and generally designated by the numeral 70. The sand control screen assembly 70 is shown disposed in the casing 12 in place of the assembly 18 and is made up of the sand control screen 14, the blank pipe section 20, the hook-up nipple 22, the hydraulic running tool 24, a sufficiently elongated section of tubing 28 which is also connected to a suitable workstring extending to the earth's surface and not shown in the drawing figure. In the arrangement illustrated in FIG. 5, a conventional wellbore packer 72, having a central bore 73, has already been installed in the casing 12 and connected to a tubing string 74 extending upwardly to a wellhead, not shown. The lower end of the tubing string 74, below the packer 72, has a suitable landing nipple or tubing section 76 connected thereto and provided with a suitable bore 78 which has annular recesses 80 and 82 formed therein for receiving conventional locking members 81 and 83, respectively, of a modified tubing seal sub 84.

The sub 84 is similar to the sub 30 except for provision of the external locking members 81 and 83 which are of a type which are spring biased into engagement with the recesses 80 and 82 but which may permit traversal of the sub 84 and the tubing 28, in assembly, through the interior of the tubing string 74 and the packer 72 which has been pre-installed in the well 10. The sub 84 is provided with opposed shear pins 54 and plural axially-spaced circumferential seal members 46 which sealingly engage the tubing 28 in the same manner as the arrangement of the sand control screen assembly 18.

Accordingly, the sub 84 may be pre-coupled to the tubing 28 together with the screen 14, blank pipe section 20, the hook-up nipple 22 and the running tool 24 and lowered through the tubing string 74 and the packer 72 until the sub 84 engages the locking recesses of the landing nipple 76. The tubing 28 may then be forced downwardly with respect to sub 84 to shear the pins 54 and permit rotation and reciprocation of the auger sand control screen 14 so that it may be installed in the gravel packing 16 in a preferred manner. During installation of the screen 14, fluid communication between the wellbore portions 13 and 15 is prevented by the packer 72 and by the tubing seal provided by the sub 84 without concern for breaking a fluid tight seal between the tubing 28 and the sub 84. As with the installation of sand control screen assembly 18, the hook-up nipple 22 and the running tool 24 may be installed in the assembly 70 above the sub 84 so that the tool 24 and the workstring to which it would be connected may be removed from the wellbore while leaving the sand control screen 14, blank pipe section 20 and the tubing 28 disposed in the wellbore and in fluid tight sealing engagement with the sub 84.

The aforedescribed elements may be fabricated using conventional oil well downhole equipment materials and manufacturing techniques. Although preferred embodiments of the invention have been described in detail herein, those skilled in the art will recognize that various substitutions and modifications may be made to the sand control screen assemblies and certain critical components thereof without departing from the scope and spirit of the invention as recited in the appended claims.

What is claimed is:

1. A sand control screen assembly for installation in a well comprising:

a sand control screen operably connected to an elongated tubing;

a tubing seal support sub including means for securing said sub in a predetermined position in a wellbore, said seal support sub including at least one circumferential seal member operably engaged with said tubing to permit reciprocation and rotation of said tubing relative to said seal support sub while maintaining a substantially fluid tight seal between spaced-apart portions of a wellbore; and frangible coupling means interconnecting said tubing and said seal support sub in such a way that said tubing, said sand control screen and said seal support sub may be run into a wellbore and said tubing disconnected from said seal support sub to permit reciprocation of said tubing relative to said seal support sub while maintaining a fluid tight seal therebetween.

2. The assembly set forth in claim 1 wherein:

said seal support sub includes a plurality of axially spaced-apart circumferential seal members disposed therein and sealingly engageable with said tubing.

3. The assembly set forth in claim 2 wherein:

said seal members comprise elastomeric members secured to said seal support sub and extending into a bore formed in said seal support sub.

4. The assembly set forth in claim 1 wherein:

said seal support sub is operably connected to a wellbore packer adapted to be run into said wellbore connected to said seal support sub and to said tubing.

5. The assembly set forth in claim 1 wherein:

said seal support sub is connected to a wellbore packer, said packer being operable to be set in said wellbore to form a fluid tight seal between spaced-apart portions of said wellbore.

6. The assembly set forth in claim 1 wherein:

said frangible coupling comprises at least one shear pin interconnecting said tubing with said seal support sub to prevent axial reciprocation of one with respect to the other until a predetermined decoupling force is exerted therebetween.

7. The assembly set forth in claim 6 wherein:

said shear pin is disposed in cooperating bores formed in said seal support sub and in said tubing and between said seal members and said sand control screen whereby, in response to shearing said shear pin, said tubing may be reciprocated with respect to said seal members without bringing said pin receiving bore in said tubing into registration with said seal members.

8. The assembly set forth in claim 1 including:

a releasable running tool interconnected in said assembly between said sand control screen and said tubing.

9. The assembly set forth in claim 1 wherein:

said sand control screen has at least one auger flight disposed thereon for rotatably augering said sand control screen into a gravel packing disposed in said wellbore.

10. The assembly set forth in claim 1 wherein:

said sub includes means for operably engaging a section of tubing disposed in said wellbore for locating said seal support sub relative to said tubing.

* * * * *